US011542626B2

(12) United States Patent
Piascik et al.

(10) Patent No.: US 11,542,626 B2
(45) Date of Patent: Jan. 3, 2023

(54) SYSTEMS AND METHODS FOR ENCLOSED ELECTROPLATING CHAMBERS

(71) Applicant: Honeywell International Inc., Morris Plains, NJ (US)

(72) Inventors: James Piascik, Randolph, NJ (US); Glenn Sklar, Randolph, NJ (US); Joseph W. Mintzer, III, Phoenix, AZ (US)

(73) Assignee: Honeywell International Inc., Charlotte, NC (US)

( * ) Notice: Subject to any disclaimer, the term of this patent is extended or adjusted under 35 U.S.C. 154(b) by 57 days.

(21) Appl. No.: 17/065,621

(22) Filed: Oct. 8, 2020

(65) Prior Publication Data

US 2022/0112621 A1 Apr. 14, 2022

(51) Int. Cl.

| | |
|---|---|
| ***C25D 17/10*** | (2006.01) |
| ***C25D 21/04*** | (2006.01) |
| ***C25D 21/08*** | (2006.01) |
| ***C25D 21/12*** | (2006.01) |
| ***C25D 17/00*** | (2006.01) |

(52) U.S. Cl.
CPC ..... *C25D 17/10* (2013.01); *C25D 17/008* (2013.01); *C25D 21/04* (2013.01); *C25D 21/08* (2013.01); *C25D 21/12* (2013.01)

(58) Field of Classification Search
CPC ... C25D 21/14–20; C25D 7/04; C25D 17/008
See application file for complete search history.

(56) References Cited

U.S. PATENT DOCUMENTS

| | | | | |
|---|---|---|---|---|
| 902,892 | A | * | 11/1908 | Lutz |
| 4,303,481 | A | | 12/1981 | Mortier et al. |
| 4,419,194 | A | | 12/1983 | Angelini |
| 4,820,395 | A | | 4/1989 | Angelini |

(Continued)

FOREIGN PATENT DOCUMENTS

| | | | |
|---|---|---|---|
| CN | 107151815 A | * | 9/2017 |
| CN | 110387570 A | | 10/2019 |

(Continued)

OTHER PUBLICATIONS

Stiegler et al., Machine Translation, WO 99/20563 A2 (Year: 1999).*

*Primary Examiner* — Ho-Sung Chung
(74) *Attorney, Agent, or Firm* — Bookoff McAndrews PLLC

(57) ABSTRACT

Systems and methods for automated electroplating are disclosed. An electroplating system includes a first chamber configured to receive one or more parts. The first chamber includes a vessel extending from a first end to a second end, a first cap proximate to the first end a first cathode contact coupled to the first end, a second cathode contact coupled to the second end, and a plurality of anodes formed on an inner surface of the vessel. The electroplating system further includes at least one reservoir and a first conduit and a second conduit each coupled between the at least one reservoir and the first chamber. The first conduit may be configured to transfer fluid from the first reservoir to the first chamber and the second conduit may be configured to transfer fluid from the first chamber to the at least one reservoir.

16 Claims, 7 Drawing Sheets

(56) References Cited

U.S. PATENT DOCUMENTS

| | | | | |
|---|---|---|---|---|
| 6,099,711 | A * | 8/2000 | Dahms | C25D 5/627 205/292 |
| 8,173,004 | B2 | 5/2012 | Hirasawa et al. | |
| 2002/0056644 | A1* | 5/2002 | Sakura | C25D 5/611 205/102 |
| 2003/0217916 | A1* | 11/2003 | Woodruff | C25D 17/001 204/275.1 |
| 2004/0217012 | A1* | 11/2004 | Gramm | C25D 21/18 205/640 |
| 2006/0076241 | A1* | 4/2006 | Schneider | C25D 17/28 204/297.06 |
| 2015/0041327 | A1* | 2/2015 | Buckalew | C25D 17/001 204/266 |
| 2016/0108542 | A1 | 4/2016 | Mochizuki et al. | |
| 2016/0115618 | A1* | 4/2016 | Arvin | C25D 21/14 422/111 |
| 2017/0370017 | A1* | 12/2017 | Keigler | C25D 17/06 |
| 2018/0016688 | A1 | 1/2018 | Angelini | |
| 2018/0266009 | A1* | 9/2018 | Koizumi | C25D 17/06 |
| 2019/0003070 | A1* | 1/2019 | Piascik | C25D 7/00 |
| 2019/0127872 | A1 | 5/2019 | He et al. | |

FOREIGN PATENT DOCUMENTS

| | | | | |
|---|---|---|---|---|
| DE | 10249572 | A1 | 5/2004 | |
| WO | WO-9910563 | A2 * | 3/1999 | C25D 17/08 |
| WO | WO-2012007525 | A1 * | 1/2012 | C25D 17/001 |

* cited by examiner

SYSTEMS AND METHODS FOR ENCLOSED ELECTROPLATING CHAMBERS

TECHNICAL FIELD

Various embodiments of the present disclosure relate generally to the field of electroplating and, more particularly, to systems and methods for improving electroplating processes using enclosed electroplating chamber systems.

BACKGROUND

Chrome plating is a very forgiving process that generally does not require meticulous cleaning and activation that most other plating systems require. Although chrome is wear resistant, non-line-of-sight, and inexpensive, chrome suffers from poor corrosion resistance and various environmental issues. Typically for chrome plating, parts are placed directly into a plating bath without any pre-treatment solutions. Further, some electroplating systems require cleaners, activators, and multiple different plating baths. However, it may be difficult to move large machinery parts (e.g., rotors used for drills in oil and gas industry) quickly between tanks or plating baths without the plated coatings passivating. As such, there is a need for an efficient and cost effective wear and corrosion resistant electroplating process.

The present disclosure is directed to overcoming one or more of these challenges. The background description provided herein is for the purpose of generally presenting the context of the disclosure. Unless otherwise indicated herein, the materials described in this section are not prior art to the claims in this application and are not admitted to be prior art, or suggestions of the prior art, by inclusion in this section.

SUMMARY OF THE DISCLOSURE

According to certain aspects of the disclosure, systems and methods are disclosed for improving electroplating processes using enclosed electroplating chamber systems.

In one embodiment, an electroplating system is disclosed. The electroplating system may comprise a first chamber configured to receive one or more parts, the first chamber including: a vessel extending from a first end to a second end; a first cap proximate to the first end; a first cathode contact coupled to the first end; a second cathode contact coupled the second end; and a plurality of anodes formed on an inner surface of the vessel. The electroplating system may further comprise: at least one reservoir; and a first conduit and a second conduit each coupled between a first reservoir and the first chamber. The first conduit may be configured to transfer fluid from the at least one reservoir to the first chamber and the second conduit may be configured to transfer fluid from the first chamber to the at least one reservoir.

In another embodiment, an electroplating chamber is disclosed. The electroplating chamber may comprise: a vessel configured to contain one or more parts, the vessel extending from a first end to a second end; at least one cap proximate to the first end or the second end; at least one cathode contact formed proximate to the first end or the second end; and at least one anode formed on an inner surface of the vessel.

In another embodiment, an electroplating method is disclosed. The method may comprise: providing, by a controller system, one or more electroplating solutions from at least one reservoir to one or more electroplating chambers; applying, by the controller system, electric current to at least one anode contact and at least one cathode contact formed on each of the one or more chambers; providing, by the controller system, the one or more chambers with rinsing fluid; detecting, by the controller system, a conductivity level of the one or more chambers; and draining, by the controller system, the one or more chambers after a rinse cycle.

Additional objects and advantages of the disclosed embodiments will be set forth in part in the description that follows, and in part will be apparent from the description, or may be learned by practice of the disclosed embodiments. The objects and advantages of the disclosed embodiments will be realized and attained by means of the elements and combinations particularly pointed out in the appended claims. As will be apparent from the embodiments below, an advantage to the disclosed systems and methods is that machinery parts may be electroplated more efficiently while being wear and corrosion resistant with the enclosed electroplating chambers.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION OF EMBODIMENTS

Figure 1:
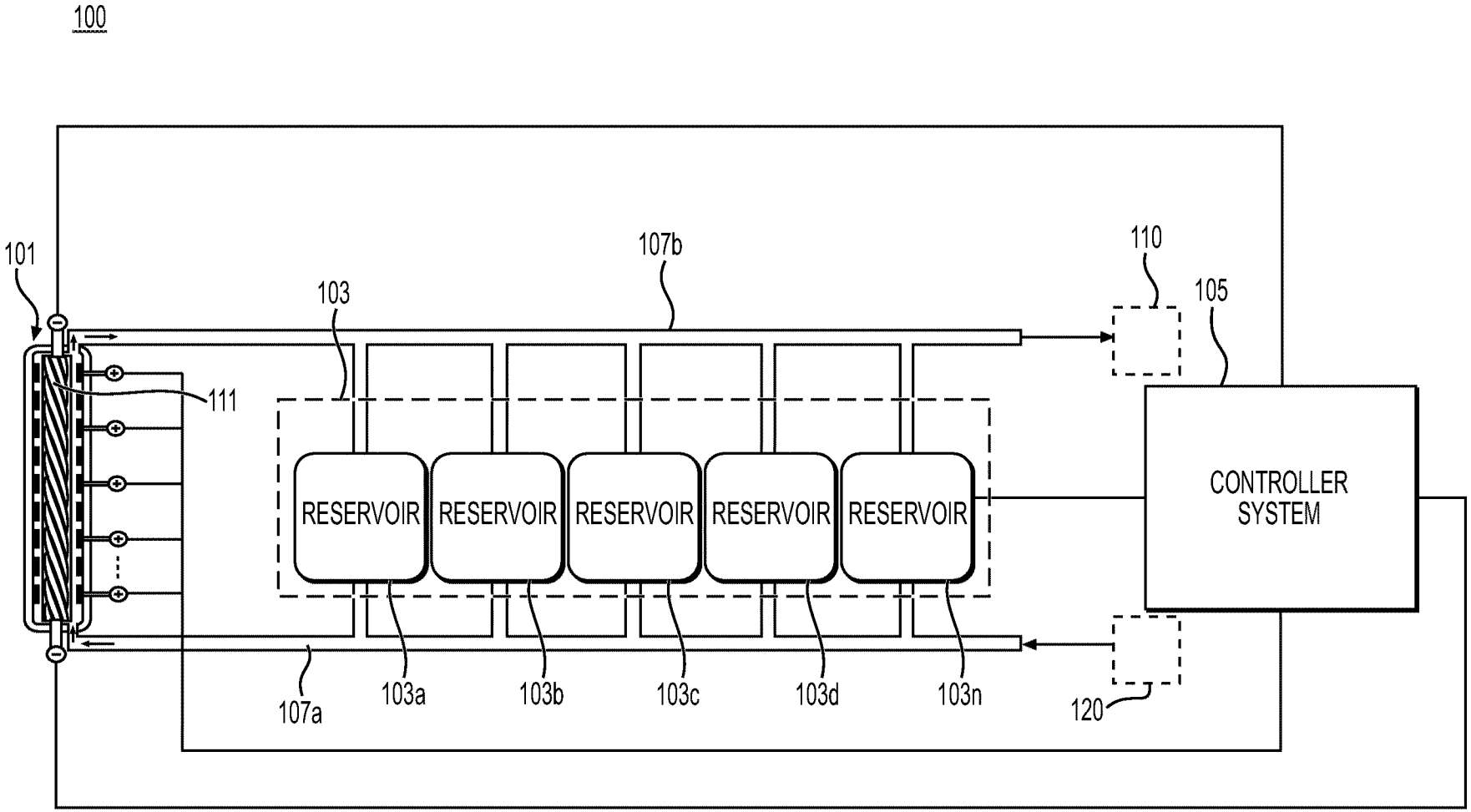
FIG. 1 depicts an overview of an example automated electroplating system, according to one or more aspect of the present disclosure.

The following embodiments describe systems and methods for improving electroplating processes using enclosed electroplating chamber systems.

As described above, there is a need in the electroplating technology to efficiently electroplate, for example, large machinery parts. For example, in the oil and gas industry, there is a need for quickly electroplating large rotors used in, for example, positive-displacement motors and/or progressive cavity pumps, without the plated coatings passivating. Accordingly, the following embodiments describe enclosed electroplating chamber systems and methods for providing fast, low cost, and wear and corrosion resistant electroplating processes. According to certain aspects of the present disclosure, one or more enclosed electroplating chambers may be provided to receive large machinery parts and apply electroplate coatings to the large machinery parts. The electroplating chambers may be connected to one or more solution reservoirs and a controller system in a closed system. The controller system may facilitate automated processes for providing electroplating fluid solutions and electric current to the one or more electroplating chambers to perform the electroplating process of the present disclosure. Further, the electroplating chambers may include multiple anodes and cathodes to improve thickness uniformity of the electroplating coatings.

As described in further detail below, the enclosed electroplating chamber systems and methods of the present disclosure will result in improvements in the electroplating technology in various aspects. The enclosed electroplating chamber of the present disclosure, which may be relatively compact compared to conventional electroplating baths, may require less chemicals and smaller tanks. Further, since large machinery parts received within the relatively compact enclosed electroplating chambers are stationary and the electroplating solutions are rapidly fed into the electroplating chambers, the likelihood of passivation between the electroplated layers may be reduced. Further, the enclosed electroplating chambers of the present disclosure, being a closed system, may reduce evaporation, exhaust emissions, and environmental contamination. Additionally, the automated closed system of the present disclosure may improve reliability and eliminate operator errors The subject matter of the present description will now be described more fully hereinafter with reference to the accompanying drawings, which form a part thereof, and which show, by way of illustration, specific exemplary embodiments. An embodiment or implementation described herein as "exemplary" is not to be construed as preferred or advantageous, for example, over other embodiments or implementations; rather, it is intended to reflect or indicate that the embodiment(s) is/are "example" embodiment(s). Subject matter can be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

The terminology used below may be interpreted in its broadest reasonable manner, even though it is being used in conjunction with a detailed description of certain specific examples of the present disclosure. Indeed, certain terms may even be emphasized below; however, any terminology intended to be interpreted in any restricted manner will be overtly and specifically defined as such in this Detailed Description section. Both the foregoing general description and the following detailed description are exemplary and explanatory only and are not restrictive of the features, as claimed.

In this disclosure, the term "based on" means "based at least in part on." The singular forms "a," "an," and "the" include plural referents unless the context dictates otherwise. The term "exemplary" is used in the sense of "example" rather than "ideal." The term "or" is meant to be inclusive and means either, any, several, or all of the listed items. The terms "comprises," "comprising," "includes," "including," or other variations thereof, are intended to cover a non-exclusive inclusion such that a process, method, or product that comprises a list of elements does not necessarily include only those elements, but may include other elements not expressly listed or inherent to such a process, method, article, or apparatus. Relative terms, such as, "substantially" and "generally," are used to indicate a possible variation of ±10% of a stated or understood value.

Referring now to the appended drawings, FIG. 1 shows an overview of an example automated electroplating system 100, according to one or more aspects of the present disclosure. In one embodiment, the system 100 may include an electroplating chamber 101 (or the chamber 101), a tankless reservoir system 103, an inlet conduit 107*a*, an outlet conduit 107*b*, and a controller system 105. In one embodiment, the chamber 101 may be configured to receive and store one or more parts or work pieces (e.g., a shaft, rod, beam, cylinder, bar, etc.) within the chamber 101. The length of the chamber 101 may be greater than 30 feet to contain large machinery parts (e.g., rotor of a positive-displacement motors or progressive cavity pumps). However, of course, the chamber 101 may be designed to be any length suitable for various applications. Further, the chamber 101 may be configured to receive various fluids from the reservoir system 103 via the inlet conduit 107*a*. In one embodiment, the reservoir system 103 may include a plurality of solution reservoirs 103*a-n*. Each of the plurality of solution reservoirs 103*a-n* may store different types of fluid solutions. For example, the plurality of solution reservoirs 103*a-n* may store water, hydrochloric acid (HCl) solution, nickel (Ni) solution, cobalt (Co) solution, and/or cobalt phosphorous (Co—P) solution. Additionally, the plurality of reservoirs 103*a-n* may be connected to pumps, actuators, and/or valves (not shown in the figures for brevity) that are configured to facilitate transferring fluid between the chamber 101 and the reservoir system 103. Additionally or alternatively, rinse water may be provided to the chamber 101 via the inlet conduit 107*a* from a separate water source 120. Further, rinse waste from the chamber 101 may be discarded via the outlet conduit 107*b* to a separate waste drain or storage 110.

Still referring to FIG. 1, the controller system 105 may control the chamber 101 and the reservoir system 103 to facilitate an automated electroplating process of the present disclosure. For example, the controller system 105 may facilitate transferring fluid between the chamber 101 and the reservoir system 103 by automatically controlling the pumps, actuators, and/or valves that are coupled to the chamber 101 and the reservoir system 103. Further, the controller system 105 may be configured to provide electric current to the chamber 101 via anode contacts and cathode contacts (later shown in FIG. 2) coupled to the chamber 101. The controller system 105 may initiate, by providing electric current via the anode and cathode contacts, a chemical reaction between an electroplating fluid solution and one or more parts or work pieces 111 contained within the chamber 101. In one embodiment, the electric current provided to the chamber 101 may be rectified by one or more rectifiers (not shown in the figures for brevity) connected to the controller system 105 and the chamber 101. In one embodiment, the system 100 may be completely automated and operated by the controller system 105 by automatically monitoring various sensors coupled to the system 100 and controlling the pumps, actuators, and/or valves based on the detected sensor signals. The manner in which various components are arranged in FIG. 1 is merely exemplary. In practice, there may be additional components, fewer components, different components, or differently arranged components than those shown in FIG. 1.

Figure 2:
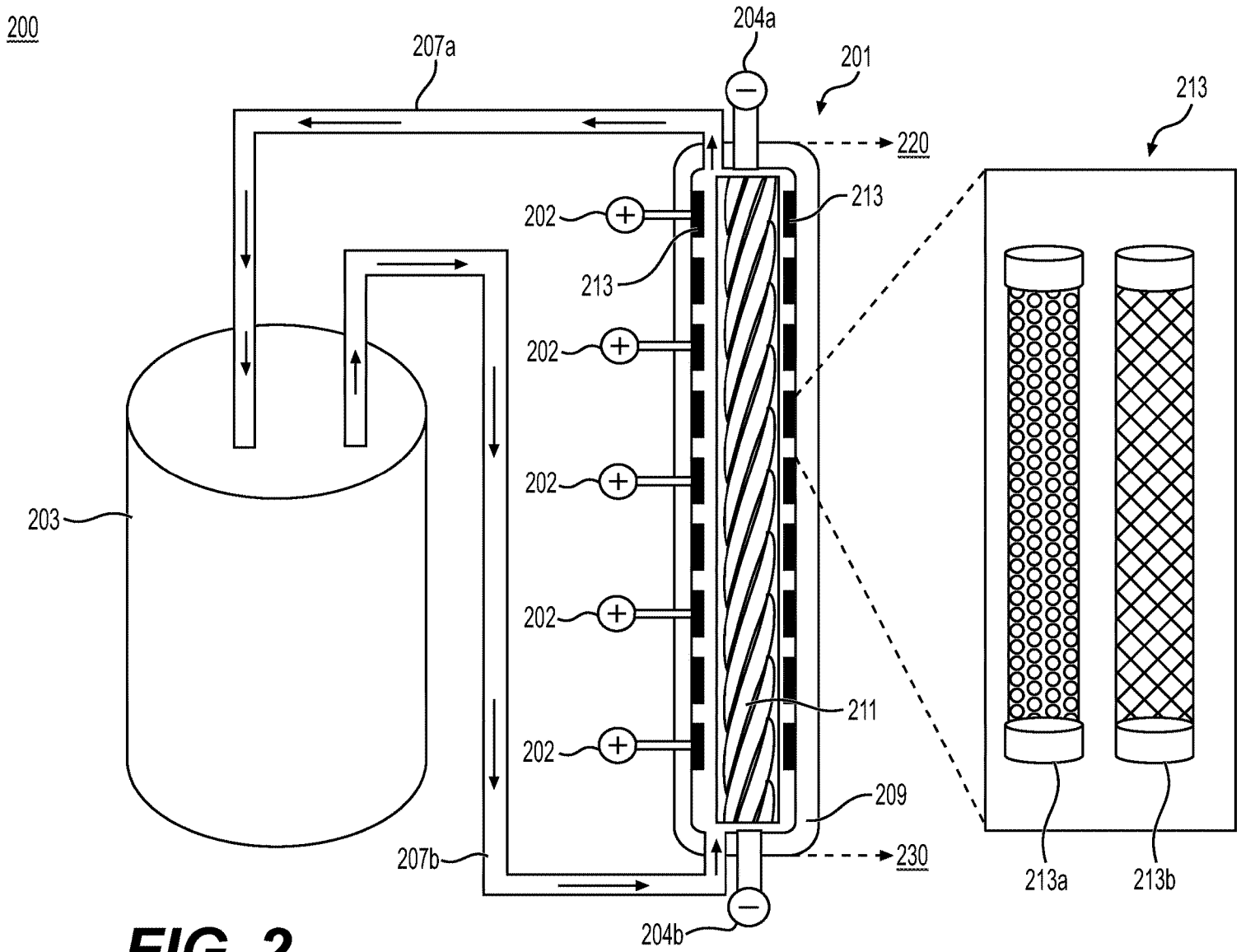
FIG. 2 depicts an example electroplating system, according to one or more aspects of the present disclosure.

FIG. 2 depicts an exemplary electroplating system 200, according to one or more aspects of the present disclosure. FIG. 2 illustrates a detailed schematic of an enclosed chamber 201 (or the chamber 201) and an arrangement of various connections between the chamber 201 and a reservoir tank 203. In one embodiment, the chamber 201 may include a hollow vessel 209, one or more anode contacts 202, a plurality of anodes 213), and cathode contacts 204*a*, 204*b*. Although five anode contacts 202 and five anodes 213 are shown for illustrative purposes, more than five contacts 202 and anodes 213 may be provided in the system 200. In one embodiment, the vessel 209 may be a hollow, substantially straight container extending from a first end 220 to a second end 230. The vessel 209 may be made of plastic, metal, or any other suitable coated metal. Further, the vessel 209 may be cylindrical. However, of course, the vessel 209 may utilize any other suitable shapes and/or sizes to accommodate the shapes and/or sizes of one or more parts or work pieces 211 selected for electroplating. Proximate to the first end 220 and/or the second end 230, the vessel 209 may include caps (later shown in FIG. 6) that are configured to open and close to seal the chamber 201 after placing the one or more parts 211 in the vessel 209. The one or more parts 211 may be arranged to be stationary in the vessel 209 that is enclosed during the electroplating process. The vessel 209 may reduce evaporation, exhaust emissions, and contamination during the electroplating process. Further, the vessel 209 may promote high humidity and eliminate the possibility of the one or more parts 211 drying out and passivating during, for example, rinse cycles between each application of electroplating coating layers. In one embodiment, the vessel 209 may be designed to be relatively compact compared to a conventional electroplating bath. As such, relatively low volume of electroplating solution may need to be provided to the vessel 209, which may yield significantly higher throughput per bath volume than conventional approaches. Further, relatively small reservoir tanks may be provided to reduce overall system building costs.

In one embodiment, the vessel 209 may be coupled to the reservoir tank 203 via an outlet conduit 207*a* and an inlet conduit 207*b*. The reservoir tank 203 may store fluid solutions (e.g., water, HCl solution, Ni solution, Co solution, or Co—P solution) that may facilitate the electroplating process of the present disclosure. Further, the reservoir tank 203 may generate heat and perform agitation and filtration on the electroplating solutions for performing the electroplating process of the present disclosure. Additionally or alternatively, the outlet conduit 207*a* and the inlet conduit 207*b* may be coupled to additional reservoir tanks or other fluid storage/container (e.g., reservoir system 103 shown in FIG. 1). In one embodiment, the fluid stored in the reservoir tank 203 may be transferred to the vessel 209 via the inlet conduit 207*b* and through the opening on the second end 230 of the vessel 209 as shown in FIG. 2. Thereafter, during and/or after the electroplating process, the fluid transferred into the vessel 209 may be transferred out through an opening on the first end 220 of the vessel 209 back into the reservoir tank 203 or other fluid storage via the outlet conduit 207*a*.

In one embodiment, the multiple anodes 213 may be arranged on the inner surfaces of the vessel 209. For example, a plurality of patches of anodes 213 may be arranged on one side of the vessel 209, extending from the first end 220 to the second end 230. Further, another plurality of patches of anodes 213 may be arranged on the opposite side of the vessel 209, extending from the first end 220 to the second end 230. In one embodiment, the anodes 213 may be provided in various shapes and sizes. For example, the anodes 213 may be cylindrical (or tubular) anodes 213*a*, 213*b*. The cylindrical anode 213*a* may include holes or apertures (e.g., perforated) penetrating through the sidewall of the cylindrical anode 213*a*. Alternatively or additionally, the cylindrical anode 213*b* may include openings in a meshed configuration, each opening penetrating through the sidewall of the cylindrical anode 213*b*. The holes or meshed openings may improve and/or facilitate the electroplating process of the present disclosure. The anodes 213 may be made from material including, for example, titanium with mixed metal oxide coating.

In one embodiment, the chamber 201 may include multiple anode contacts 202 connected to the anodes 213. The anode contacts 202 may be connected to the respective anodes 213 via corresponding openings that penetrate through the sidewall of the vessel 209. Providing multiple anode contacts 202 may improve plating thickness uniformity by reducing voltage drop along the anodes 213. Additionally, the multiple anode contacts 202 may improve current distribution to the chamber 201. Further, multiple rectifiers may be utilized and coupled with the multiple anode contacts 202 to improve and maintain the plating thickness uniformity. In one embodiment, the multiple anode contacts 202 and the anodes 213 may be arranged and coupled in accordance with suitable and precise spacing that may improve electroplating coating thickness uniformity while reducing nodule growth.

In one embodiment, the chamber 201 may include cathode contacts 204*a*, 204*b*. A first cathode contact 204*a* may be inserted into the vessel 209 through an opening at the first end 220 of the chamber 201. In some embodiments, the first cathode contact 204*a* may be a part of a cap attached to the vessel 209, which allows for insertion and retrieval of parts for electroplating (e.g., FIG. 6). Further, a second cathode contact 204*b* may be inserted into the vessel 209 through an opening at the second end 230 of the chamber 201. Providing dual cathode contacts 204*a*, 204*b* on the first end 220 and the second end 230 of the chamber 201 may reduce voltage drop due to resistance and may improve electroplating coating thickness uniformity.

In accordance with one exemplary embodiment of the present disclosure, the system 200 may be coupled to a controller system (e.g., controller system 105 in FIG. 1). In one exemplary electroplating process, the controller system 105 may be configured to control pumps, actuators, and/or valves connected to the system 200 to transfer fluid solutions from the reservoir tank 203 into the vessel 209. The controller system 105 may then provide electric current to the anode contacts 202 and the cathodes 204*a*-*b*. In one embodiment, the controller system 105 may monitor the progress of the electroplating process by using various sensors placed at suitable locations of the system 200. In accordance with the sensor signals, the controller system 105 may flush out any fluid solution remaining in the vessel 209. For example, the controller system 105 may flush out the fluid solution in the vessel 209 after each electroplating cycle. Further, the controller system 105 may provide water from the reservoir tank 203 or any other water source to the vessel 209 to rinse the one or more parts 211 and the inner surfaces of the vessel 209 during and/or after the electroplating process. In one embodiment, the above-described electroplating process utilizing the controller system 105 may be fully automated, thereby reducing labor, operator exposure, and errors due to operator oversight.

Figure 3:
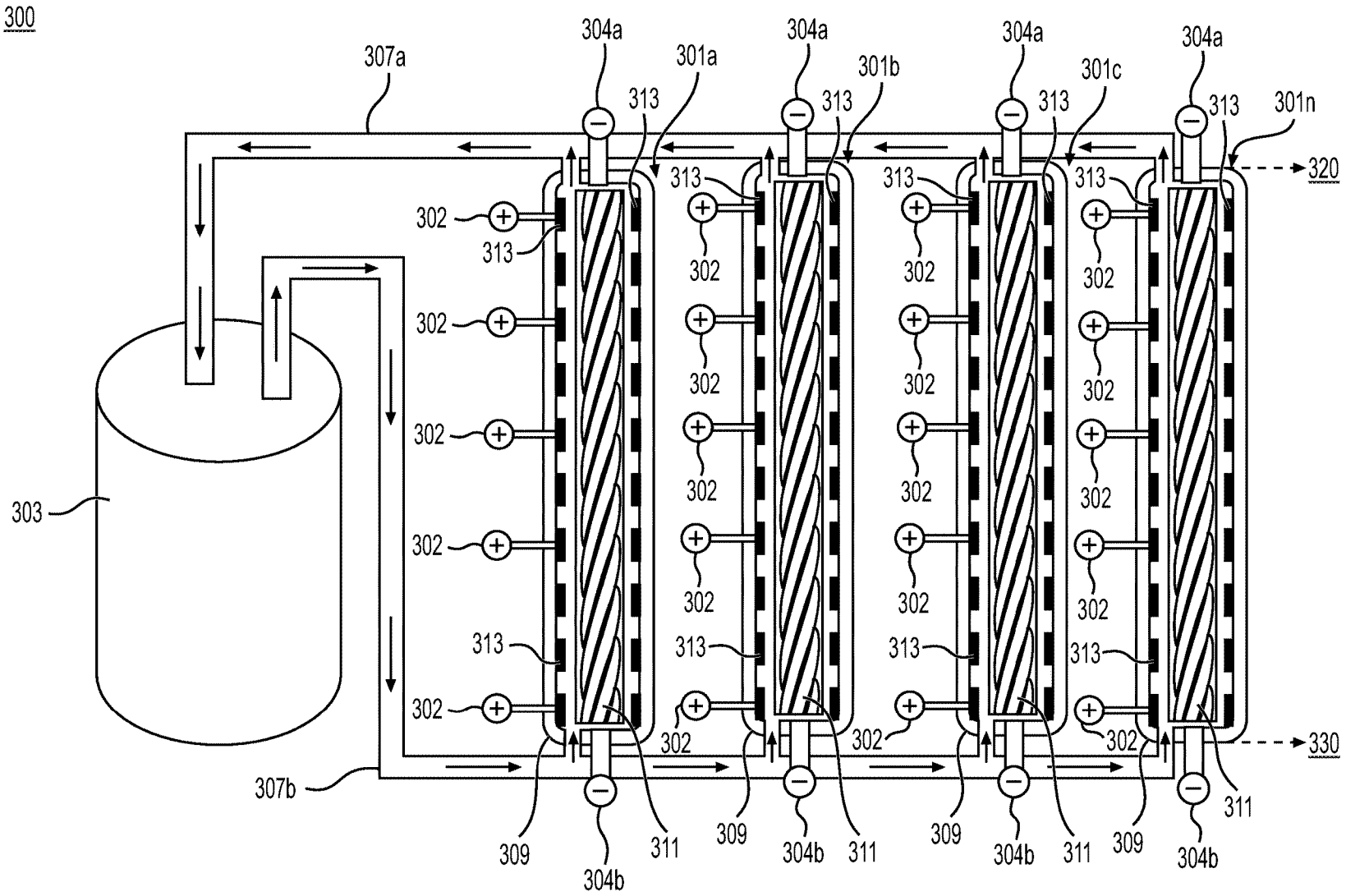
FIG. 3 depicts another example electroplating system, according to one or more aspects of the present disclosure.

FIG. 3 depicts an exemplary electroplating system 300, according to one or more aspects of the present disclosure. FIG. 3 illustrates in detail how multiple chambers 301*a-n* and a reservoir tank 303 are arranged in the electroplating system 300. Each of the multiple chambers 301*a-n* may include substantially similar structural characteristics as the chamber 201 described in FIG. 2. For example, each of the multiple chambers 301*a-n* may include a hollow vessel 309, one or more anode contacts 302, a plurality of anodes 313, and cathode contacts 304*a*, 304*b*. Although five anode contacts 302 and five anodes 313 are shown for each of the chambers 301*a-n* for illustrative purposes, more than five contacts 302 and anodes 313 may be provided for each of the chambers 301*a-n* in the system 300. In one embodiment, the vessel 309 may be a hollow container extending from a first end 320 to a second end 330. The vessel 309 may be made of plastic, metal, or any other suitable coated metal. Further, the vessel 309 may be cylindrical. However, of course, the vessel 309 may utilize any other suitable shapes and/or sizes to accommodate the shapes and/or sizes of one or more parts or work pieces 311 selected for electroplating. Proximate to the first end 320 and the second end 330, each vessel 309 may include caps (later shown in FIG. 6) that may be configured to open and close to seal each of the chambers 301*a-n* after placing the one or more parts 311 in each vessel 309. The one or more parts 311 may be arranged to be stationary in the vessels 309 that are enclosed during the electroplating process of the present disclosure.

In this exemplary embodiment, the multiple chambers 301*a-n* may be coupled to the reservoir tank 303 through an outlet conduit 307*a* and an inlet conduit 307*b*. Each of the multiple chambers 301*a-n* may include openings at the first end 320 and the second end 330. As such, the outlet conduit 307*a* may be coupled to each of the multiple chambers 301*a-n* through the opening at the first end 320, and the inlet conduit 307*b* may be coupled to each of the multiple chambers 301*a-n* through the opening at the second end 330. A single reservoir tank 303 may provide electroplating fluid solutions to the multiple chambers 301*a-n*. Alternatively, multiple reservoir tanks separately storing electroplating fluid solutions may be provided to transfer the electroplating fluid solutions to the multiple chambers 301*a-n*. Further, the system 300 may be connected to a controller system (e.g., controller system 105) to perform the electroplating process of the present disclosure in a manner similar to that described in reference to FIGS. 1 and 2. In this exemplary configuration, the multiple parts 311 may be simultaneously electroplated in a manner similar to the electroplating process described in reference to FIGS. 1 and 2. Since the multiple parts 311 may be simultaneously electroplated together in the multiple chambers 301*a-n* using a single reservoir tank 303, the amount of equipment necessary for electroplating (e.g., additional tanks, rectifiers, pumps, valves, etc.) may be significantly reduced to save costs while increasing the speed at which the parts are electroplated.

Figure 4:
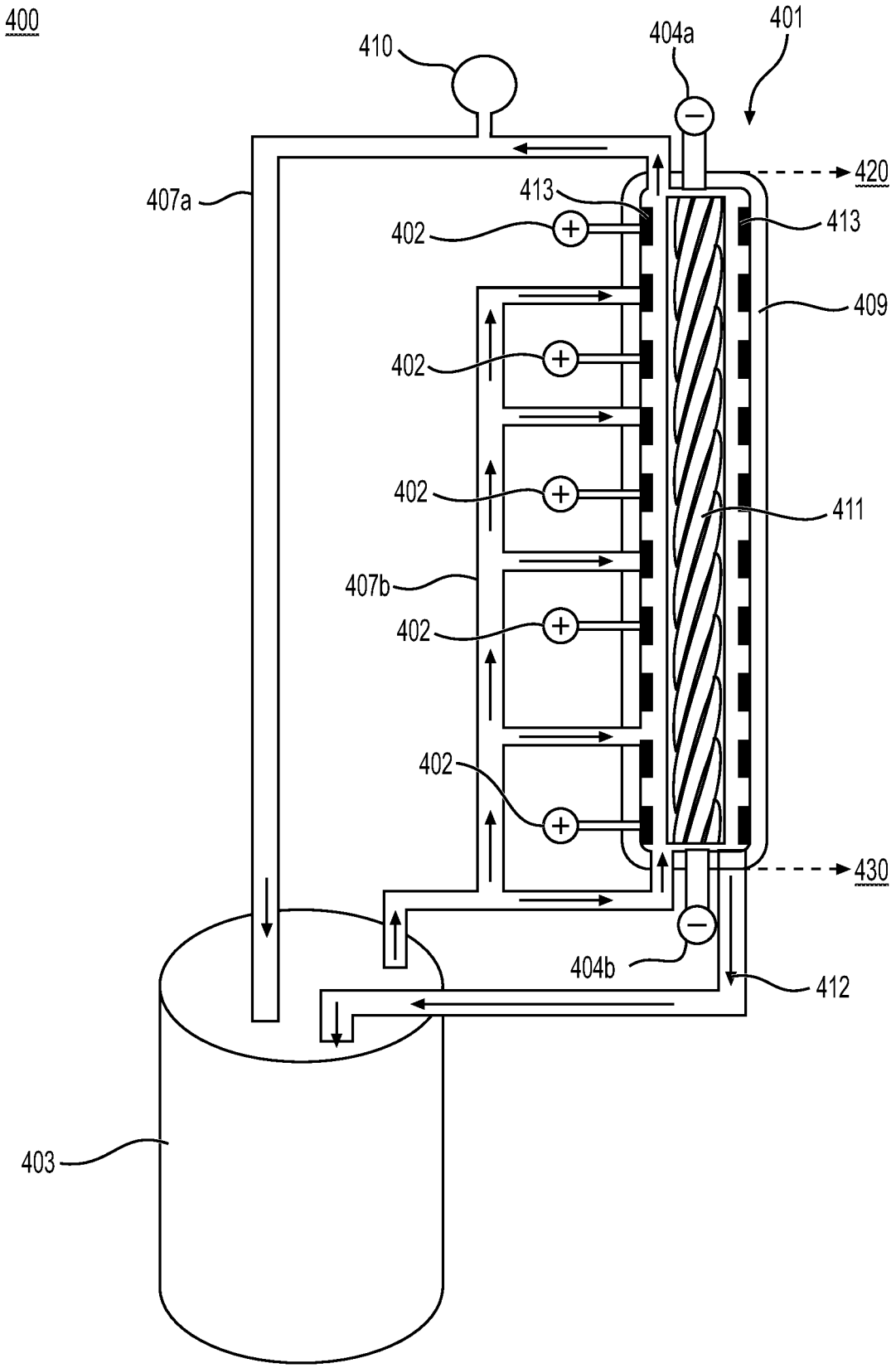
FIG. 4 depicts another example electroplating system, according to one or more aspects of the present disclosure.

FIG. 4 depicts an exemplary electroplating system 400, according to one or more aspects of the present disclosure. FIG. 4 illustrates a detailed schematic of an electroplating chamber 401 and an arrangement of various connections between the chamber 401 and a reservoir tank 403. The chamber 401 may include substantially similar structural characteristics as the chamber 201 described in FIG. 2. For example, the chamber 401 may include a hollow vessel 409, one or more anode contacts 402, one or more anodes 413, and cathode contacts 404*a*, 404*b*. Although five anode contacts 402 and five anodes 413 are shown for illustrative purposes, more than five contacts 402 and anodes 413 may be provided for the system 400. In one embodiment, the vessel 409 may be a hollow container extending from a first end 420 to a second end 430. The vessel 409 may be made of plastic, metal, or any other suitable coated metal. Further, the vessel 409 may be cylindrical. However, of course, the vessel 409 may employ any other suitable shapes and/or sizes to accommodate the shape and/or size of one or more parts or work pieces 411 selected to be electroplated. Proximate to the first end 420 and the second end 430, the vessel 409 may include caps (later shown in FIG. 6) that are configured to open and close to seal the chamber 401 after placing the one or more parts 411 in the vessel 409. The one or more parts 411 may be arranged to be stationary in the vessel 409 that is enclosed during the electroplating process.

In this embodiment, the chamber 401 may be connected to the reservoir tank 403 through an outlet conduit 407*a* and an inlet conduit 407*b*. The chamber 401 may include openings at the first end 420 and the second end 430. The reservoir tank 403 that is a single reservoir tank may provide electroplating fluid solutions to the chamber 401, or multiple reservoir tanks separately storing the electroplating fluid solutions may be provided to transfer the electroplating fluid solutions to the chamber 401. Further, the system 400 may be connected to a controller system (e.g., controller system 105) to perform the electroplating process of the present disclosure. In this exemplary configuration, the vessel 409 may further include a plurality of openings on a side of the vessel 409 running vertically from the first end 420 to the second end 430 (i.e., a column of openings). The inlet conduit 407*b* may be connected to each of the plurality of openings on the side of the vessel 409 to transfer the electroplating fluid solutions from the reservoir tank 403 to the vessel 409 through the plurality of openings. Supplying the fluid solutions via the plurality of openings may reduce time for completing the overall electroplating process of the present disclosure.

In one embodiment, electroplating fluid solutions may be filled in the chamber 401 from the second end 430 to the first end 420 of the chamber 401, which may help purge various gasses (e.g., hydrogen ($H_2$) and oxygen ($O_2$) gasses) formed during electroplating cycles. Further, the chamber 401 may be rinsed with appropriate fluid (e.g., water) after each electroplating cycle where different fluid solutions (e.g., HCl solution, Ni solution, Co solution, or Co—P solution) may be supplied to the one or more parts 411. Alternatively, the rinse solution may also fill the chamber 401 from the second end 430 to the first end 420 of the chamber 401. In one embodiment, a conductivity probe 410 may be provided between the reservoir tank 403 and the chamber 401. The conductivity probe 410 may be attached to the outlet conduit 407*a*. The conductivity probe 410 may determine when a rinse cycle is completed. Additionally, the system 400 may include a drain conduit 412 (e.g., a gravity drain conduit or a reverse pump flow drain conduit) connected to the vessel 409 at an opening of the vessel 409 at the second end 430 as shown in FIG. 4. The drain conduit 412 may help facilitate emptying and flushing the vessel 409 of the rinse fluid, so as to perform more efficient rinsing and reduce dilution of subsequent electroplating solutions provided to the vessel 409. In one embodiment, the rinse fluid in the vessel 409 may be emptied through the drain conduit 412 (e.g., a gravity drain conduit or a pump assisted top to bottom drain conduit) when the conductivity probe determines that the fluid passing through the outlet conduit 407*a* is above, below, and/or equal to a predetermined conductivity.

Figure 5:
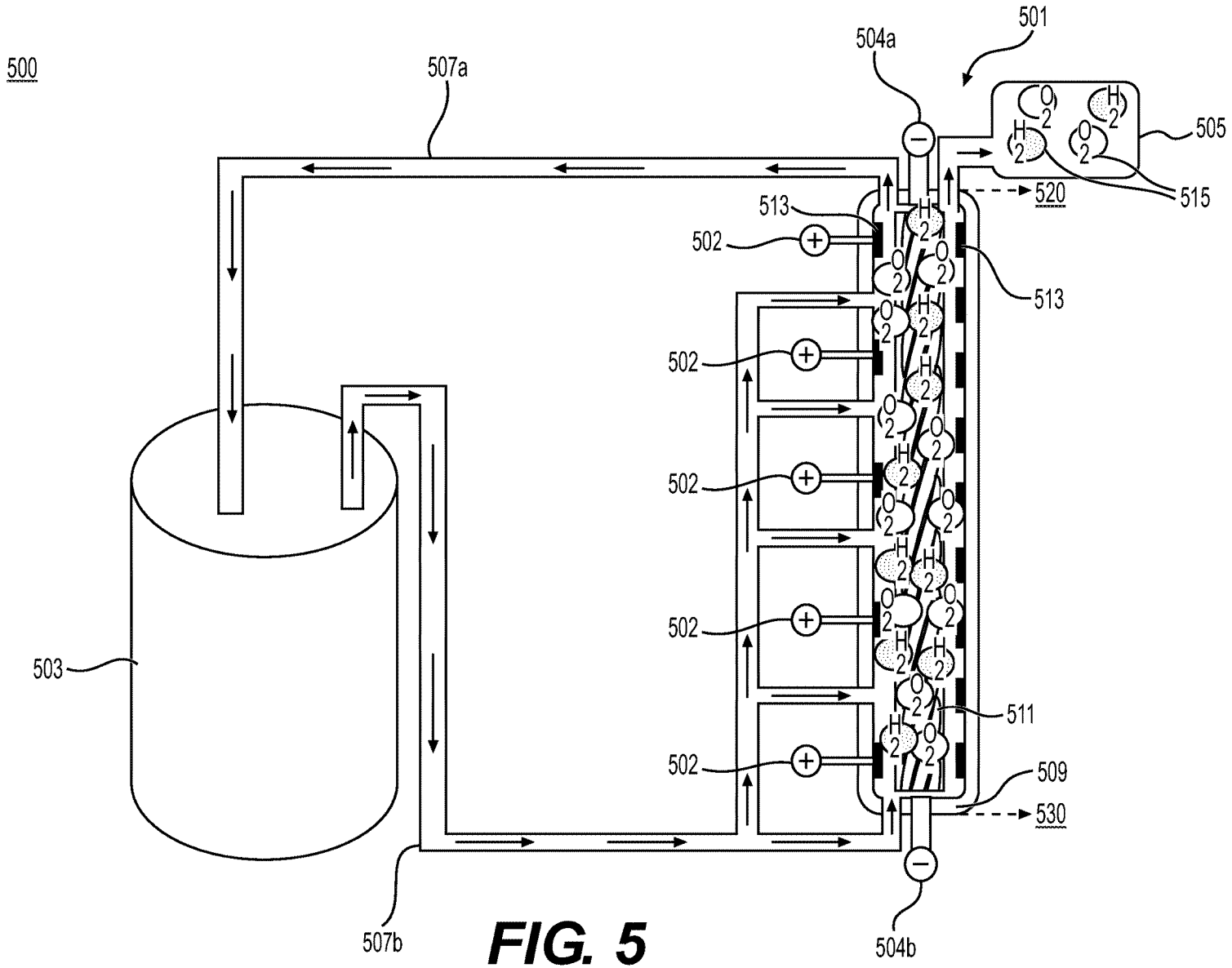
FIG. 5 depicts another example electroplating system, according to one or more aspects of the present disclosure.

FIG. 5 depicts an exemplary electroplating system 500, according to one or more aspects of the present disclosure. The system 500 may be arranged similarly as the systems 100-400 described above. Additionally, the system 500 may include a gas collector 505. In one embodiment, the cathode contacts 504*a*, 504*b* may release $H_2$ gas, and the anodes 513 may release $O_2$ gas during an electroplating process. In the case of the chamber 501 having a length greater than 30 feet, for example, a significant amount of gas may accumulate near the first end 520 of the chamber 501. As such, the gas collector 505 may be provided to collect, dilute, and vent the $H_2$ and $O_2$ gasses released during the electroplating process.

Figure 6:
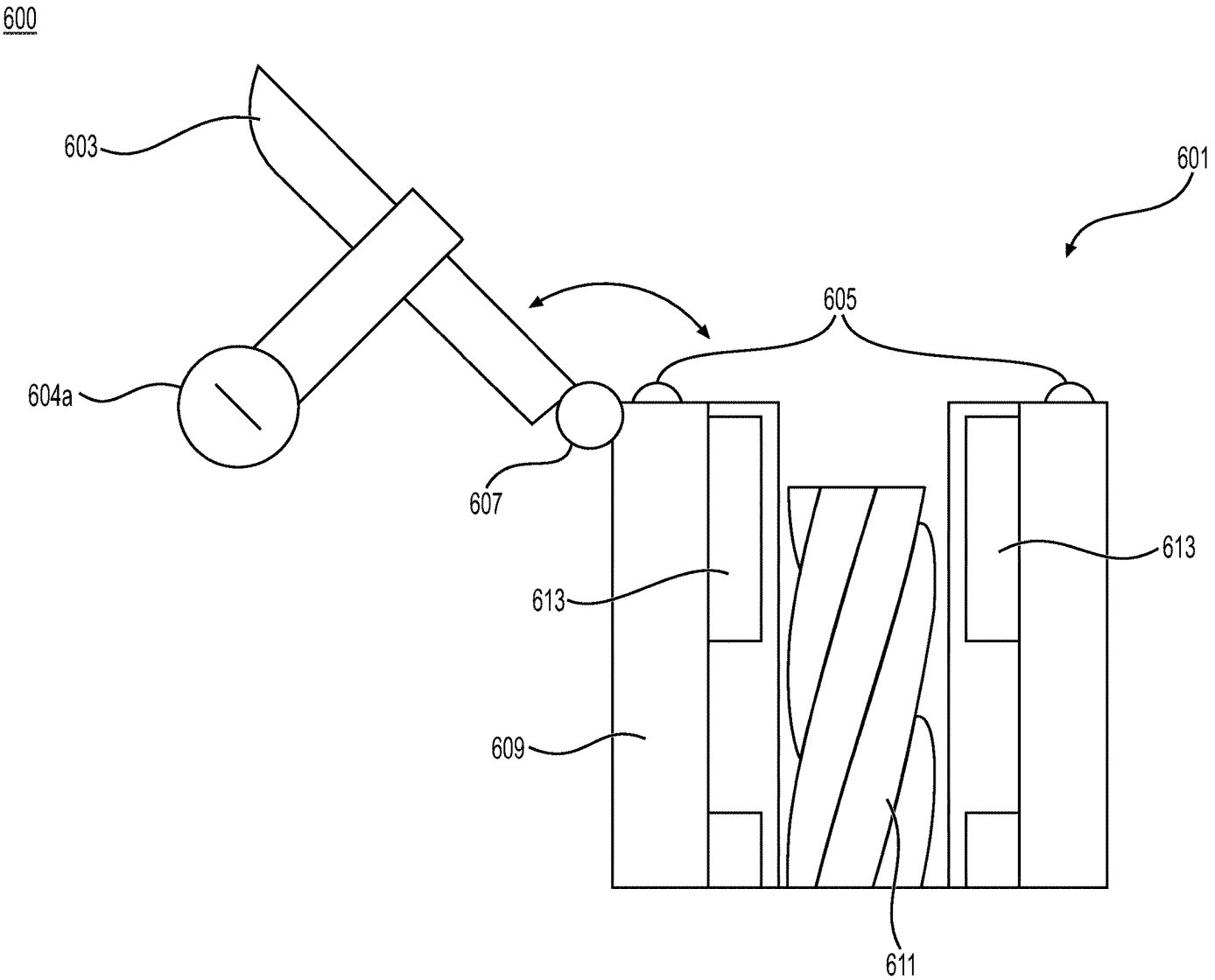
FIG. 6 depicts a schematic view of an example cap for use with an electroplating system, according to one or more aspects of the present disclosure.

FIG. 6 depicts an exemplary electroplating system 600, according one or more aspects of the present disclosure. The system 600 shows a portion of a chamber 601, which may be utilized as any one or more of the chambers of the systems 100-500. In one embodiment, the chamber 601 may include caps 603 on both ends (i.e., first and second ends) of the vessel 609 (FIG. 6 only shows one end of the chamber 601 for brevity). The cap 603 may include a cathode contact 604*a* inserted through an opening in the cap 603, extending from one side to the other of the cap 603 as shown in FIG. 6. Further, the cap 603 may be connected to the vessel 609 via a hinge 607. The hinge 607 may be any suitable hinge that may be configured to allow the caps 603 to rotate about an axis of the vessel 609 to facilitate opening and closing of the distal ends of the vessel 609. Additionally, the chamber 601 may include a seal 605 (e.g., an O-Ring seal) to provide a tight seal between the cap 603 and the vessel 609. The chamber 601 may be a tightly sealed enclosed chamber to promote high humidity in the chamber 601 and reduce the likelihood of one or more parts 611 drying out and passivating during the electroplating process of the present disclosure.

Figure 7B:
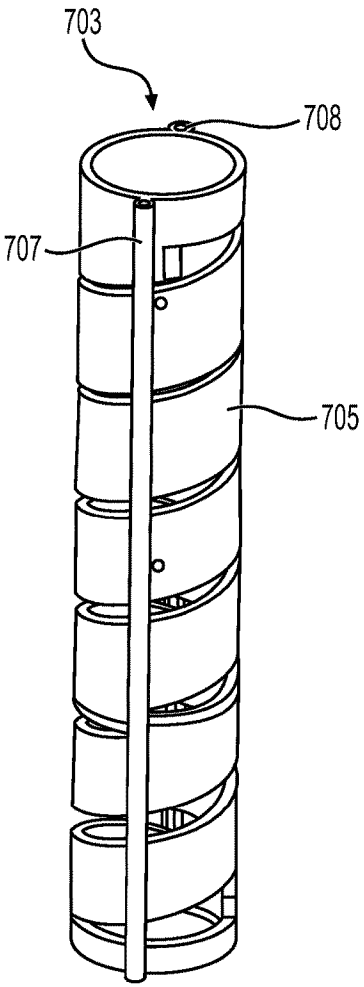
FIG. 7B depicts a more detailed schematic view of an example shielding for use with an electroplating system, according to one or more aspects of the present disclosure.
Figure 7A:
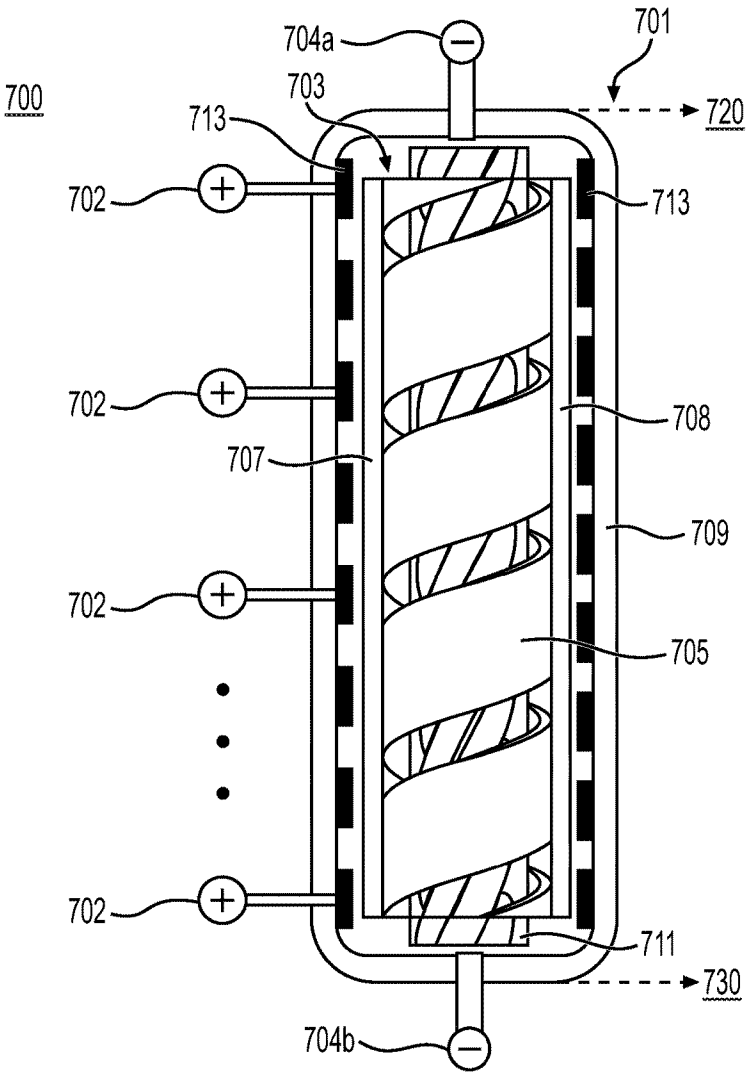
FIG. 7A depicts a schematic view of an example shielding for use with an electroplating system, according to one or more aspects of the present disclosure.

FIG. 7A depicts an exemplary electroplating system 700 implemented with an exemplary shielding 703, according to one or more aspects of the present disclosure. FIG. 7B illustrates a perspective view of the exemplary shielding 703, according to one or more aspects of the present disclosure. Reference will be made to both FIGS. 7A and 7B in the following description. As shown in FIG. 7A, the system 700 may include a chamber 701, which may be utilized as any one or more of the chambers of the systems 100-600. In one embodiment, a shielding 703 may be inserted into the space inside the vessel 709. The shielding 703 may be a plastic helical hollow tube with radially rotating or spiral-shaped surfaces 705 extending downward from a first end 720 to a second end 730 as shown in FIG. 7A. The shielding 703 may include radially rotating openings between the radially rotating surfaces 705 extending from the first end 720 to the second end 730. In other words, the shielding 703 may be a spiral-shaped enclosure that extends vertically, and may include a continuous opening extending approximately from one end to the other end in between the spiral-shaped surfaces 705 of the enclosure. The shielding 703 may be inserted within the vessel 709 between anodes 713 and one or more parts or work pieces 711. Therefore, the shielding 703 may enclose or "house" the part 711 within the vessel 709. As shown in FIG. 7B, the shielding 703 may include vertical columns 707, 708 formed on opposite ends of the periphery of the shielding 703. The vertical columns 707, 708 having a cylindrical shape may extend approximately from the first end 720 and the second end 730 of the vessel 709. In some embodiments however, the lengths of the vertical columns, as well as the length of the shielding 703, may depend on the lengths of the part 711 to be electroplated. The shielding 703 may facilitate even deposition of electroplating coating on the one or more parts 711. Utilizing the shielding 703 in electroplating a part 711 that may include varying shapes and features (e.g., major and minor features of a rotor) may reduce the time required for obtaining sufficient electroplating coating thickness on the part 711. For example, the surfaces 705 of the shielding 703 between the major features of the part 711 and anodes 713 may prevent the major features from progressively drawing current away from the minor features of the part 711. As such, more uniform alloy composition and microstructure may be provided across the entire part 711, resulting in more consistent coating properties and reduction of poorly plated local areas. Further, less grinding and polishing may be required because the major features of the part 711 may not be heavily over-plated compared to the minor features of the part 711.

The computing device that may execute techniques described herein may include processor(s) (e.g., CPU, GPU, or other processing unit), a memory, and communication interface(s) (e.g., a network interface) to communicate with other devices. The memory may include volatile memory, such as RAM, and/or non-volatile memory, such as ROM and storage media. Examples of storage media include solid-state storage media (e.g., solid state drives and/or removable flash memory), optical storage media (e.g., optical discs), and/or magnetic storage media (e.g., hard disk drives). The aforementioned instructions and/or processes (e.g., software or computer-readable code) for performing the electroplating process of the present disclosure may be stored in any volatile and/or non-volatile memory component of memory. The computing device may, in some embodiments, further include input device(s) (e.g., a keyboard, mouse, or touchscreen) and output device(s) (e.g., a display, printer). For example, if the controller system 105 includes a tablet computer, the controller system 105 may have a touchscreen and a display. The aforementioned elements of the computing device may be connected to one another through a bus. In some embodiments, the processor (s) of the computing device includes both a CPU and a GPU.

Instructions executable by one or more processors may be stored on a non-transitory computer-readable medium. Therefore, whenever a computer-implemented method is described in this disclosure, this disclosure shall also be understood as describing a non-transitory computer-readable medium storing instructions that, when executed by one or more processors, configure and/or cause the one or more processors to perform the computer-implemented method. Examples of non-transitory computer-readable medium include RAM, ROM, solid-state storage media (e.g., solid state drives), optical storage media (e.g., optical discs), and magnetic storage media (e.g., hard disk drives). A non-transitory computer-readable medium may be part of the memory of a computer system or separate from any computer system.

It should be appreciated that in the above description of exemplary embodiments, various features are sometimes grouped together in a single embodiment, figure, or description thereof for the purpose of streamlining the disclosure and aiding in the understanding of one or more of the various aspects. This method of disclosure, however, is not to be interpreted as reflecting an intention that the claimed embodiment requires more features than are expressly recited in each claim. Thus, the claims following the Detailed Description are hereby expressly incorporated into this Detailed Description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

Thus, while certain embodiments have been described, those skilled in the art will recognize that other and further modifications may be made thereto without departing from the spirit of the disclosure, and it is intended to claim all such changes and modifications as falling within the scope of the disclosure. For example, functionality may be added or deleted from the block diagrams and operations may be interchanged among functional blocks. Steps may be added or deleted to methods described within the scope of the present disclosure.

The above disclosed subject matter is to be considered illustrative, and not restrictive, and the appended claims are intended to cover all such modifications, enhancements, and other implementations, which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description. While various implementations of the disclosure have been described, it will be apparent to those of ordinary skill in the art that many more implementations and implementations are possible within the scope of the disclosure. Accordingly, the disclosure is not to be restricted.

What is claimed is:

1. An electroplating system comprising:

a first chamber configured to receive one or more parts, the first chamber including:

a vessel extending from a first end to a second end;

a first cap proximate to the first end;

a first cathode contact coupled to the first end;

a second cathode contact coupled to the second end; and a plurality of anodes formed on an inner surface of the vessel;

at least one reservoir;

a first conduit and a second conduit each coupled between the at least one reservoir and the first chamber, wherein the first conduit is configured to transfer fluid from the at least one reservoir to the first chamber and the second conduit is configured to transfer fluid from the first chamber to the at least one reservoir; and a shield configured to enclose one or more parts within the vessel, wherein the shield is a hollow helical cylinder.

2. The electroplating system of claim 1, wherein each of the plurality of anodes includes a cylinder with a plurality of openings on a surface of the cylinder.

3. The electroplating system of claim 1, further comprising:

a controller system configured to operate the at least one reservoir and the first chamber to transfer fluid between the at least one reservoir and the first chamber.

4. The electroplating system of claim 1, further comprising:

a second chamber configured to receive additional one or more parts, wherein the first and second conduits are extended to the second chamber to transfer fluid between the second chamber and the at least one reservoir.

5. The electroplating system of claim 1, further comprising:

a controller system configured to simultaneously electroplate the one or more parts in the first chamber and an additional one or more parts in a second chamber.

6. The electroplating system of claim 1, further comprising:

one or more pumps, one or more valves, and/or one or more rectifiers coupled to the at least one reservoir and the first chamber.

7. The electroplating system of claim 1, further comprising:

a conductivity probe coupled to the second conduit, wherein the conductivity probe is configured to detect a rinse cycle being completed.

8. The electroplating system of claim 7, further comprising:

a gravity drain formed proximate to the second end, wherein the gravity drain is configured to flush fluid in the first chamber after the rinse cycle is completed.

9. The electroplating system of claim 1, further comprising:

a gas collector coupled to the first chamber;

wherein the gas collector is configured to collect gas accumulated in the first chamber.

10. The electroplating system of claim 1, further comprising:

a second cap proximate to the second end.

11. The electroplating system of claim 1, wherein the shield is formed of plastic.

12. The electroplating system of claim 1, wherein the at least one reservoir is configured to heat, agitate and/or filter electroplating solution stored in the at least one reservoir.

13. The electroplating system of claim 1, wherein the first conduit is coupled to the first chamber via a plurality of conduit extensions attached to different sections of the first chamber.

14. An electroplating chamber comprising:

a vessel configured to contain one or more parts, the vessel extending from a first end to a second end;

at least one cap proximate to the first end or the second end;

at least one cathode contact formed proximate to the first end or the second end;

at least one anode formed on an inner surface of the vessel; and a shield configured to enclose the one or more parts within the vessel, wherein the shield is a hollow helical cylinder.

15. The electroplating chamber of claim 14, further comprising:

a gravity drain formed proximate to the second end, wherein the gravity drain is configured to flush fluid in the electroplating chamber after a rinse cycle is completed.

16. The electroplating chamber of claim 14, further comprising:

a plurality of openings on a first side and/or a second side of the vessel, wherein a plurality of conduits are coupled to the vessel via the plurality of openings.

* * * * *